United States Patent [19]

Wacker

[11] Patent Number: 4,862,607

[45] Date of Patent: Sep. 5, 1989

[54] REMOTE CONTROLLED SNOWTHROWER DISCHARGE CHUTE DEFLECTOR

[75] Inventor: Robert W. Wacker, Plymouth, Wis.

[73] Assignee: Outboard Marine Corporation, Waukegan, Ill.

[21] Appl. No.: 253,062

[22] Filed: Oct. 3, 1988

[51] Int. Cl.[4] ..... E01H 5/09

[52] U.S. Cl. ..... 37/260

[58] Field of Search ..... 37/260–262; 406/160–161; 56/13.3, 13.4; 193/22, 25 A, 23, 30

[56] References Cited

U.S. PATENT DOCUMENTS

| | | | |
|---|---|---|---|
| 840,603 | 1/1907 | Bodvig | 37/260 X |
| 1,096,041 | 5/1914 | Link | 37/262 |
| 1,535,913 | 4/1925 | Fuller et al. | 37/260 |
| 2,496,472 | 2/1950 | Huddle | 37/260 X |
| 2,642,680 | 6/1953 | Curtis | 37/260 |
| 2,778,510 | 1/1957 | Mayhill et al. | 37/260 |
| 2,971,279 | 2/1961 | Blanchet | 37/260 |
| 3,075,813 | 1/1963 | Vohl | 37/260 |
| 3,088,779 | 12/1963 | Vachon | 37/260 |
| 3,251,631 | 4/1965 | Hennen | 37/260 |
| 3,483,960 | 11/1967 | Wightman et al. | 37/260 |
| 3,510,171 | 5/1970 | Bacon | 37/260 |
| 3,808,715 | 5/1974 | Haban | 37/260 |
| 3,828,450 | 8/1974 | Boeck | 37/260 |
| 3,867,773 | 2/1975 | Gunderson | 37/260 |
| 3,879,866 | 4/1975 | Gunderson | 37/260 |
| 4,011,668 | 3/1977 | Gunderson | 37/260 |
| 4,138,829 | 2/1979 | Chase | 37/262 |
| 4,255,879 | 3/1981 | Greider | 37/260 |
| 4,255,881 | 3/1981 | Fralish | 37/260 |
| 4,549,365 | 11/1985 | Johnson | 37/260 |

*Primary Examiner*—E. H. Eickholt

*Attorney, Agent, or Firm*—Michael, Best & Friedrich

[57] ABSTRACT

A snowthrower comprising a discharge chute having an outer end, a deflector mounted on the outer end of the discharge chute for pivotal movement relative thereto about an axis, and a mechanism for selectively pivoting the deflector relative to the discharge chute, the mechanism including a guide rod having opposite first and second ends, a pin connecting the first end of the guide rod to the deflector at a point spaced from the axis, a compression spring telescoped over the rod and including a first end fixed relative to the discharge chute and a second end fixed relative to the second end of the rod, and a cable for selectively moving the rod in the direction from the second end to the first end.

19 Claims, 1 Drawing Sheet

REMOTE CONTROLLED SNOWTHROWER DISCHARGE CHUTE DEFLECTOR

BACKGROUND OF THE INVENTION

The invention relates to snowthrowers, and, more particularly, to remote controlled discharge chute deflectors for snowthrowers.

It is known to provide snowthrowers with discharge chute deflectors that can be controlled from the operator's position behind the snowthrower so that it is not necessary for the operator to come from behind the snowthrower to change the direction of the discharge. See, for example, U.S. Greider Patent No. 4,205,468, issued June 3, 1980.

Attention is also directed to the following U.S. patents:

| | | |
|---|---|---|
| Bodvig | 840,603 | Jan. 8, 1907 |
| Link | 1,096,041 | May 12, 1914 |
| Fulcer, et al. | 1,535,913 | Apr. 25, 1925 |
| Huddle | 2,496,472 | Feb. 7, 1950 |
| Curtis, et al. | 2,642,680 | Jun. 23, 1953 |
| Mayhill, et al. | 2,778,510 | Jan. 22, 1957 |
| Blanchet | 2,971,279 | Feb. 14, 1961 |
| Vohl | 3,075,813 | Jan. 29, 1963 |
| Vachon | 3,088,779 | Dec. 18, 1961 |
| Hennen | 3,251,631 | Apr. 15, 1965 |
| Wightman, et al. | 3,483,960 | Nov. 24, 1967 |
| Bacon | 3,510,171 | May 5, 1970 |
| Gunderson | 3,867,773 | Feb. 25, 1975 |
| Gunderson | 3,879,866 | Apr. 29, 1975 |
| Gunderson | 4,011,668 | Mar. 15, 1977 |
| Chase | 4,138,829 | Feb. 13, 1979 |
| Fralish | 4,255,881 | Mar. 17, 1981 |
| Johnson | 4,549,365 | Oct. 29, 1985 |

SUMMARY OF THE INVENTION

The invention provides a snowthrower comprising a discharge chute having an outer end, a deflector mounted on the outer end of the discharge chute for pivotal movement relative thereto about an axis, and means for selectively pivoting the deflector relative to the discharge chute, the means including a guide rod having opposite first and second ends, means for connecting the first end of the guide rod to the deflector at a point spaced from the axis, means for biasing the rod in the direction from the first end to the second end, the biasing means including a compression spring telescoped over the rod and including a first end fixed relative to the discharge chute and a second end fixed relative to the second end of the rod, and means for selectively moving the rod in the direction from the second end to the first end.

The invention also provides a snowthrower comprising a discharge chute having an outer end, a deflector mounted on the outer end of the discharge chute for pivotal movement relative thereto about an axis, and means for selectively pivoting the deflector relative to the discharge chute, the means including a guide rod having opposite first and second ends, means for connecting the first end of the guide rod to the deflector at a point spaced from the axis, means for biasing the rod in the direction from the first en to the second end, and means for selectively moving the rod in the direction from the second end to the first end, the means for moving the rod including a pull-pull cable including a sheath and a core slidably housed in the sheath, the core having an end fixed to the second end of the rod.

The invention also provides a snowthrower comprising a discharge chute having an outer end, a projection extending from the discharge chute and having therethrough an aperture, a deflector mounted on the outer end of the discharge chute for pivotal movement relative thereto about an axis, and means for selectively pivoting the deflector relative to the discharge chute, the means including a guide rod extending through the aperture and having opposite first and second ends, means for connecting the first end of the guide rod to the deflector at a point spaced from the axis, means for biasing the rod in the direction from the first end to the second end, and means for selectively moving the rod in the direction from the second end to the first end.

A principal feature of the invention is the above described means for selectively pivoting the deflector relative to the discharge chute. This arrangement is very compact and permits the moving parts to be protected by a simple cover so that snow and ice do not accumulate on the moving parts and interfere with operation.

Other features and advantages of the invention will become apparent to those skilled in the art upon review of the following detailed description, claims and drawings.

Figure 1:
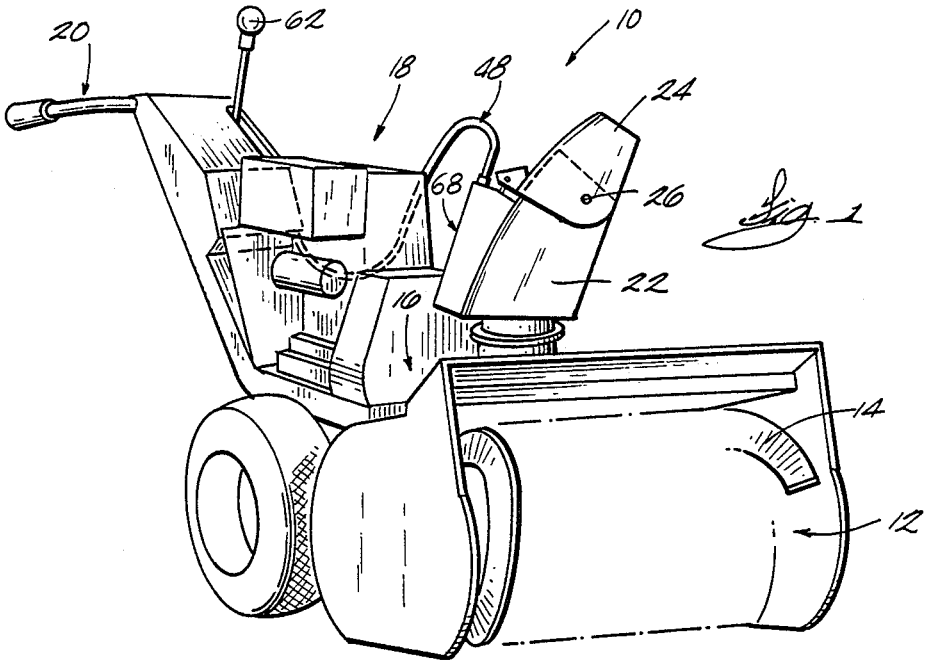
FIG. 1 is a perspective view of a snowthrower embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A snowthrower 10 embodying invention is illustrated in the drawings. As shown in FIG. 1, the snowthrower 10 comprises an auger chamber 12 having therein an auger 14, and an impeller chamber 16 having therein an impeller (not shown). The snowthrower 10 also includes an engine 18 drivingly connected to the impeller and to the auger 14. The snowthrower 10 further comprises a rearwardly extending handle and control assembly 20.

The snowthrower 10 also comprises a discharge chute 22 having an outer or upper end, and a deflector 24 mounted on the upper end of the discharge chute 22 for pivotal movement relative thereto about an axis 26.

The snowthrower 10 further comprises means for selectively pivoting the deflector 24 relative to the discharge chute 22. While various suitable means can be employed, in the preferred embodiment, such means includes (see FIG. 2) a guide rod 28 having opposite first and second or upper and lower ends 30 and 32, respectively. The rod 28 is L-shaped and includes a transverse extension 34 at its lower end 32. The pivoting means also includes means for connecting the upper end 30 of the guide rod 28 to the deflector 24 at a point spaced from the pivot axis 26. While various suitable connecting means can be used, in the illustrated construction, such means includes a pivot pin 36 which extends through the upper end 30 of the guide rod 28 and through a rearwardly extending projection 38 on the deflector 24.

The pivoting means also includes means for biasing the guide rod 28 downwardly or in the direction from the upper end 30 to the lower end 32. While various suitable biasing means can be employed, in the preferred embodiment, such means includes a compression spring 40 telescoped over the guide rod 28 and including a first or upper end 42 fixed relative to the discharge chute 22 and a second or lower end 44 fixed relative to the lower end 32 of the guide rod 28. More particularly, the guide rod 28 has thereon, adjacent the lower end 32 thereof, an annular, cup-shaped member 46 which is fixed relative to the guide rod 28 and against which the second or lower end 44 of the spring 40 bears. The manner in which the upper end 42 of the spring 40 is fixed relative to the discharge chute 22 is described hereinafter.

The pivoting means also includes means for selectively moving the guide rod 28 upwardly or in the direction from the lower end 32 to the upper end 30. While various suitable moving means can be used, in the illustrated construction, this means includes a pull-pull cable 48 including a sheath 50 and a core 52 slidably housed in the sheath 50. The core 52 has opposite first and second ends, 54 and 56, respectively, and the portion of the core 52 adjacent the second end 56 thereof extends adjacent and parallel to the guide rod 28. The second end 56 of the core 52 is fixed to the transverse extension 34 at the lower end 32 of the guide rod 28 by suitable means. The sheath 50 has opposite first and second ends 58 and 60, respectively. The first end 58 of the sheath 50 is fixed to the handle and control assembly 20, and the second end 60 of the sheath 50 is fixed relative to the discharge chute 22 in a manner described hereinafter. The pull-pull cable 48 is mounted on the snowthrower 10 so that rotation of the discharge chute 22 about its vertical axis does not affect operation of the pivoting means.

Figure 3:
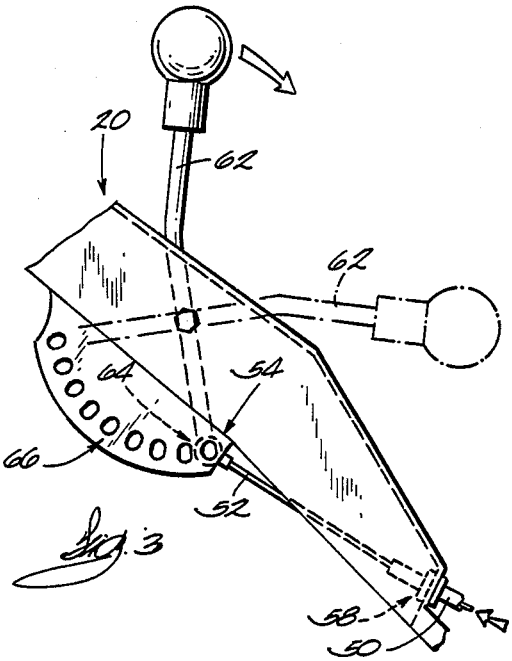
FIG. 3 is an enlarged view, partially in section, of the operating handle for selecively pivoting the deflector.

The means for moving the guide rod 28 also includes means for selectively moving the core 52 relative to the sheath 50. In the preferred embodiment, the means for moving the core 52 relative to the sheath 50 includes an operating handle 62 which is pivotally mounted on the handle and control assembly 20 and which has an end 64 pivotally connected to the first end 54 of the core 52. As is apparent from viewing FIG. 3, clockwise movement of the operating handle 62 relative to the handle and control assembly 20 pulls the first end 54 of the core 52 away from the first end 58 of the sheath 50 and pulls the second end 56 of the core 52 toward the second end 60 of the sheath 50. In the preferred embodiment, the operating handle 62 and the handle and control assembly 20 include detent means 66 defining discrete positions for the operating handle 62 so that the deflector 24 can be located in discrete positions.

Figure 2:
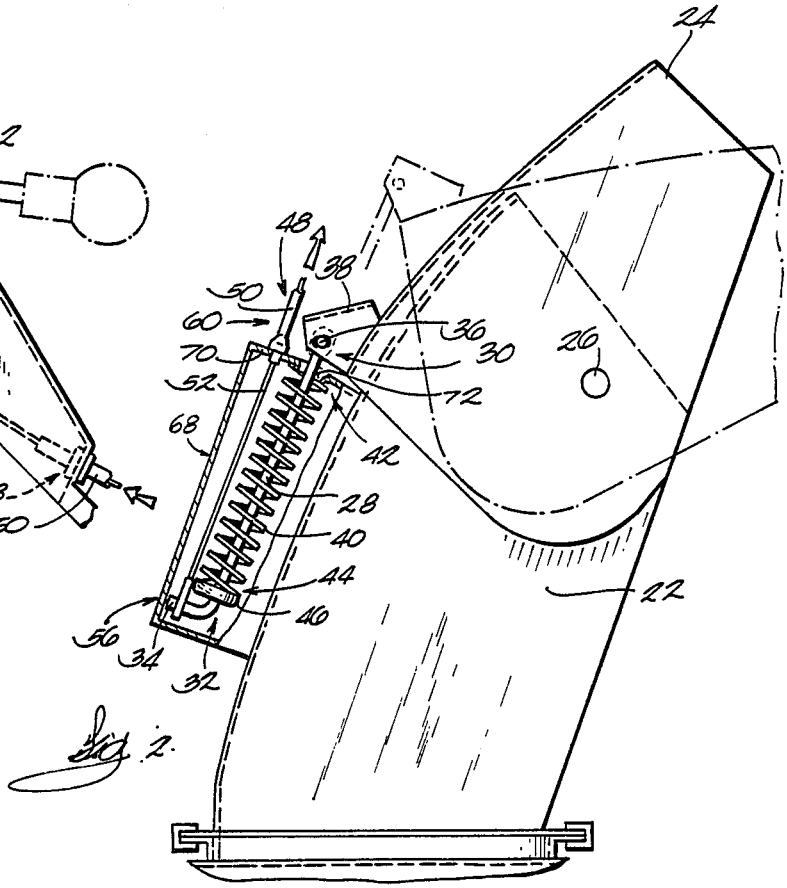
FIG. 2 is an enlarged view, partially in section, of the discharge chute, the deflector and the means for selectively pivoting the deflector relative to the discharge chute.

The snowthrower 10 further comprises a cover 68 which is mounted on the discharge chute 22 and which encloses the spring 40, the portion of the core 52 extending from the second end 60 of the sheath 50, and a portion of the guide rod 28. As shown in FIG. 2., the cover 68 includes an upper wall 70 which constitutes a projection extending rearwardly or transversely from the discharge chute 22. The wall 70 has therein an aperture 72 through which the guide rod 28 extends. The upper end 42 of the spring 40 bears against the wall 70 and is thereby fixed relative to the discharge chute 22, and the second end of the sheath is fixed to the wall 70 and is thereby fixed relative to the discharge chute 22.

The pivoting means operates as follows. Clockwise movement of the operating handle 62 pulls the second end 56 of the core 52 upwardly, as explained above. This moves the guide rod 28 upwardly, against the force of the spring 40, and thereby pivots the deflector 24 clockwise as shown in FIG. 2. Counterclockwise movement of the operating handle 62 allows the spring 40 to move the guide rod 28 downwardly. Downward movement of the guide rod 28 both pulls the second end 56 of the core 52 away from the second end 60 of the sheath 50 and also pivots the deflector 24 counterclockwise.

Various features of the invention are set forth in the following claims.

I claim:

1. A snowthrower comprising a discharge chute having an outer end, a deflector mounted on said outer end of said discharge chute for pivotal movement relative thereto about an axis, and means for selectively pivoting said deflector relative to said discharge chute, said means including a guide rod having opposite first and second ends, means for connecting said first end of said guide rod to said deflector at a point spaced from said axis, means for biasing said rod in the the direction from said first end to said second end, said biasing means including a compression spring telescoped over said rod and including a first end fixed relative to said discharge chute and a second end fixed relative to said second end of said rod, and means for selectively moving said rod in the direction from said second end to said first end.

2. A snowthrower as set forth in claim 1 and further comprising a cover which is mounted on said discharge chute and which encloses said spring and at least a portion of said rod.

3. A snowthrower as set forth in claim 2 wherein said cover includes a wall having therethrough an aperture, wherein said rod extends through said aperture, and wherein said first end of said spring bears against said wall.

4. A snowthrower as set forth in claim 1 wherein said means for moving said rod includes a pull-pull cable including a sheath and a core slidably housed in said sheath, said core having an end fixed to said second end of said rod.

5. A snowthrower as set forth in claim 4 and further comprising a cover which is mounted on said discharge chute and which encloses said spring, a portion of said cable and at least a portion of said rod.

6. A snowthrower as set forth in claim 5 wherein said cover includes a wall having therethrough an aperture, wherein said rod extends through said aperture, and wherein said sheath has an end fixed to said wall.

7. A snowthrower comprising a discharge chute having an outer end, a deflector mounted on said outer end of said discharge chute for pivotal movement relative thereto about an axis, and means for selectively pivoting said deflector relative to said discharge chute, said means including a guide rod having opposite first and second ends, means for connecting said first end of said guide rod to said deflector at a point spaced from said axis, means for biasing said rod in the direction from said first end to said second end, and means for selectively moving said rod in the direction from said second end to said first end, said means for moving said rod including a pull-pull cable including a sheath and a core slidably housed in said sheath, said core having an end fixed to said second end of said rod.

8. A snowthrower as set forth in claim 7 and further comprising a cover which is mounted on said discharge chute and which encloses a portion of said cable and at least a portion of said rod.

9. A snowthrower as set forth in claim 8 wherein said cover includes a wall having therethrough an aperture, wherein said rod extends through said aperture, and wherein said sheath has an end fixed to said wall.

10. A snowthrower as set forth in claim 7 wherein said biasing means includes a compression spring telescoped over said rod and including a first end fixed relative to said discharge chute and a second end fixed relative to said second end of said rod.

11. A snowthrower as set forth in claim 10 and further comprising a cover which is mounted on said discharge chute and which encloses said spring, a portion of said cable and at least a portion of said rod.

12. A snowthrower as set forth in claim 11 wherein said cover includes a wall having therethrough an aperture, wherein said rod extends through said aperture, and wherein said first end of said spring bears against said wall.

13. A snowthrower comprising a discharge chute having an outer end, a projection extending from said discharge chute and having therethrough an aperture, a deflector mounted on said outer end of said discharge chute for pivotal movement relative thereto about an axis, and means for selectively pivoting said deflector relative to said discharge chute, said means including a guide rod extending through said aperture and having opposite first and second ends, means for connecting said first end of said guide rod to said deflector at a point spaced from said axis, means for biasing said rod in the the direction from said first end to said second end, and means for selectively moving said rod in the direction from said second end to said first end.

14. A snowthrower as set forth in claim 13 and further comprising a cover which is mounted on said discharge chute, which encloses at least a portion of said rod, and which includes a wall defining said projection.

15. A snowthrower as set forth in claim 13 wherein said biasing means includes a compression spring telescoped over said rod and including a first end bearing against said projection and a second end fixed relative to said second end of said rod.

16. A snowthrower as set forth in claim 15 and further comprising a cover which is mounted on said discharge chute, which encloses said spring and at least a portion of said rod, and which includes a wall defining said projection.

17. A snowthrower as set forth in claim 13 wherein said means for moving said rod includes a pull-pull cable including a sheath and a core slidably housed in said sheath, said core having an end fixed to said second end of said rod.

18. A snowthrower as set forth in claim 17 and further comprising a cover which is mounted on said discharge chute and which encloses a portion of said cable and at least a portion of said rod.

19. A snowthrower as set forth in claim 18 wherein said cover includes a wall defining said projection, and wherein said sheath has an end fixed to said wall.

* * * * *